US012209348B2

(12) United States Patent
Kim et al.

(10) Patent No.: US 12,209,348 B2
(45) Date of Patent: Jan. 28, 2025

(54) ADDITIVE SUPPLY UNIT AND WASHING MACHINE INCLUDING THE SAME

(71) Applicant: LG ELECTRONICS INC., Seoul (KR)

(72) Inventors: Hyun Dong Kim, Seoul (KR); Jae Yong Jeong, Seoul (KR); Soo Young Oh, Seoul (KR); Kyo Soon Chae, Seoul (KR)

(73) Assignee: LG Electronics Inc., Seoul (KR)

( * ) Notice: Subject to any disclaimer, the term of this patent is extended or adjusted under 35 U.S.C. 154(b) by 477 days.

(21) Appl. No.: 17/764,798

(22) PCT Filed: Aug. 10, 2020

(86) PCT No.: PCT/KR2020/010560
§ 371 (c)(1),
(2) Date: Mar. 29, 2022

(87) PCT Pub. No.: WO2021/066315
PCT Pub. Date: Apr. 8, 2021

(65) Prior Publication Data

US 2022/0341082 A1 Oct. 27, 2022

(30) Foreign Application Priority Data

Sep. 30, 2019 (KR) ..... 10-2019-0120658

(51) Int. Cl.
*D06F 39/02* (2006.01)
*D06F 39/08* (2006.01)

(52) U.S. Cl.
CPC ..... *D06F 39/022* (2013.01); *D06F 39/028* (2013.01); *D06F 39/088* (2013.01)

(58) Field of Classification Search
CPC ..... D06F 39/022
See application file for complete search history.

(56) References Cited

U.S. PATENT DOCUMENTS

2006/0117811 A1 6/2006 Kinnetz
2006/0272360 A1 12/2006 Hsu et al.
2008/0235880 A1 10/2008 Kim et al.

FOREIGN PATENT DOCUMENTS

CN 106758011 5/2017
CN 106758011 A 5/2017
(Continued)

OTHER PUBLICATIONS

Extended European Search Report in European Appln. No. 20873145.5, mailed on Sep. 28, 2023, 8 pages.
(Continued)

*Primary Examiner* — Jason Y Ko
(74) *Attorney, Agent, or Firm* — Fish & Richardson P.C.

(57) ABSTRACT

An additive supply apparatus includes a cartridge configured to accommodate a liquid additive and discharge the additive through a discharge port thereof, a discharge tube connected to the cartridge and configured to guide the additive discharged from the cartridge, a check valve assembly interposed between the cartridge and the discharge tube and configured to selectively open or close the discharge tube and the discharge port of the cartridge based on a change in pressure, a pump configured to generate the pressure to be provided to the check valve assembly, a pressure tube that connects the pump to the check valve assembly and configured to transmit the pressure to the check valve assembly, and a water supply tube coupled to the discharge tube or the check valve assembly and configured to supply washing water to at least one of the discharge tube or the check valve assembly.

20 Claims, 8 Drawing Sheets

(56) References Cited

FOREIGN PATENT DOCUMENTS

| | | | |
|---|---|---|---|
| CN | 107287833 | | 10/2017 |
| CN | 107447423 | A | 12/2017 |
| EP | 2573251 | | 3/2013 |
| JP | 2011193967 | | 10/2011 |
| KR | 20140046181 | | 4/2014 |
| KR | 20170082082 | | 7/2017 |
| KR | 20180031669 | | 3/2018 |
| KR | 20180079969 | | 7/2018 |
| KR | 20180080013 | | 7/2018 |
| KR | 20190083261 | A | 7/2019 |
| WO | WO2019044305 | A1 | 5/2020 |

OTHER PUBLICATIONS

Office Action in Chinese Appln. No. 202080068847.7, mailed on Apr. 20, 2023, 37 pages (with English translation).

ADDITIVE SUPPLY UNIT AND WASHING MACHINE INCLUDING THE SAME

CROSS-REFERENCE TO RELATED APPLICATIONS

This application is a National Stage application under 35 U.S.C. § 371 of International Application No. PCT/KR2020/010560, filed on Aug. 10, 2020, which claims the benefit of priority to Korean Patent Application No. 10-2019-0120658, entitled "ADDITIVE SUPPLYING UNIT AND WASHING MACHINE INCLUDING THE SAME," filed on Sep. 30, 2019. The disclosures of the prior applications are incorporated by reference in their entirety.

TECHNICAL FIELD

The present disclosure relates to an additive supply unit and a washing machine including the same, and more particularly, to an additive supply unit and a washing machine including the same, which supplies a stored additive to a washing tub.

BACKGROUND

A washing machine refers to a device for treating laundry by performing various operations such as washing, spin-drying, and/or drying. The washing machine refers to a device for removing contaminants attached to laundry (hereinafter, also referred to as "cloth") by using water and a detergent.

Recently, as various types of laundry are required to be washed, various methods of treating laundry are also required. In particular, to meet users' requirements, the detergent and various additives such as a fabric softener are used to treat the laundry.

Therefore, there is an increasing interest in a washing machine equipped with an additive supply device that automatically blends and supplies various types of additives suitable for laundry. Therefore, technologies related to the washing machine are actively being developed.

Regarding the washing machine described above, Korean Patent Application Laid-Open No. 10-2018-0079969 (hereinafter, referred to as 'Related Document 1') discloses a washing machine and a method of controlling the washing machine.

Specifically, Related Document 1 discloses a configuration in which a detergent supply container, which is easily detachable, is used to automatically supply a detergent to a washing tub.

However, the washing machine disclosed in Related Document 1 is merely configured to make it easy to automatically supply various types of additives by using a motor and a pump. However, Related Document 1 does not consider a configuration for improving usability and maintenance performance by washing a path through which the additive is discharged.

In addition, the motors and the pumps need to be provided for the respective detergent supply containers to supply a plurality of additives, which may cause a relatively complicated configuration.

Further, Korean Patent Application Laid-Open No. 10-2018-0080013 (hereinafter, referred to as 'Related Document 2') also discloses a washing machine and a method of controlling the washing machine.

Specifically, Related Document 2 discloses a configuration that intuitively provides a user with operations related to the amount of detergent remaining in a detergent box and a supply of the detergent.

However, the washing machine according to Related Document 2 is also provided without considering a configuration for washing a path through which the additive is discharged. Further, pumps need to be provided for respective supply boxes to supply a plurality of additives, which causes a relatively complicated configuration.

In addition, it can be said that the configuration in which the component for supplying the additive integrated with the washing machine differs from the configuration in which at least a part is separated or replaced, as necessary.

As described above, there is a need to optimize the discharge path for the additive, the structure of the additive supply unit, and the structure of the washing machine equipped with the additive supply unit. However, the washing machine in the related art cannot appropriately satisfy the need.

SUMMARY

An object of the present disclosure is to solve the above-mentioned problems of the additive supply unit and the washing machine including the same in the related art.

Specifically, an object of the present disclosure is to wash a discharge path for an additive after the additive is discharged from a cartridge, thereby preventing the discharge path from being clogged or contaminated.

Another object of the present disclosure is to further simplify a structure of an additive supply unit by providing a discharge pressure to a cartridge only by using a single pump even in a case in which a plurality of different additives is supplied.

Still another object of the present disclosure is to provide a configuration in which at least a part of an additive supply unit may be replaced and separated from a washing machine, as necessary, thereby further optimizing a structure of the washing machine.

Technical problems to be solved by the present disclosure are not limited to the above-mentioned technical problems, and other technical problems, which are not mentioned above, may be clearly understood from the following descriptions by those skilled in the art to which the present disclosure pertains.

To achieve the above-mentioned objects or the other objects, an additive supply unit and a washing machine including the same according to one aspect of the present disclosure are configured such that a discharge path for an additive is washed after the additive is discharged from a cartridge. Specifically, after the discharge of the additive is completed, at least one of a discharge tube and a check valve assembly may be washed by washing water supplied through a water supply tube.

In addition, according to the additive supply unit and the washing machine including the same according to one aspect of the present disclosure, a plurality of cartridges capable of accommodating different additives may be installed, and the discharge tubes, the check valve assemblies, and pressure tubes may be installed to correspond to the plurality of cartridges.

In addition, according to the additive supply unit and the washing machine including the same according to one aspect of the present disclosure, a discharge pressure may be provided from the single pump to the plurality of installed cartridges. Specifically, a flow path switching valve may be installed and selectively provide the pressure generated from the pump to any one of the plurality of cartridges.

In addition, according to the additive supply unit and the washing machine including the same according to one aspect of the present disclosure, the additive supply unit and the washing tub may be connected to each other by means of a bendable, stretchable, and flexible tube.

In addition, according to the additive supply unit and the washing machine including the same according to one aspect of the present disclosure, a piston of the pump may provide a pressure for discharging the additive while reciprocating in a cylinder.

In addition, according to the additive supply unit and the washing machine including the same according to one aspect of the present disclosure, when the disc rotatably installed in the housing of the flow path switching valve rotates, the spring valves may selectively open or close some of the plurality of connectors, thereby selectively providing the pressure.

In addition, according to the additive supply unit and the washing machine including the same according to one aspect of the present disclosure, the check valve assembly may include the first and second check valves configured to be opened or closed in opposite directions depending on change in pressure in the check valve assembly.

In addition, according to the additive supply unit and the washing machine including the same according to one aspect of the present disclosure, a part of the additive supply unit may be installed on the cabinet cover, and the remaining portion of the additive supply unit may be installed in the cabinet.

In this case, according to the additive supply unit and the washing machine including the same according to one aspect of the present disclosure, at least a part of an additive supply unit may be replaced and separated from a washing machine, as necessary. Specifically, the cartridge and the check valve assembly may be separately installed on the cabinet cover. The cartridge and the check valve assembly may be coupled to the pump and the flow path switching valve installed in the cabinet, and then used, as necessary.

In addition, according to the additive supply unit and the washing machine including the same according to one aspect of the present disclosure, the hydraulic pressure of the washing water supplied from the water supply tube may be transmitted into the check valve assembly and used as the pressure for discharging the additive.

The technical solutions obtained by the present disclosure are not limited to the aforementioned technical solutions, and other technical solutions, which are not mentioned above, will be clearly understood by those skilled in the art from the following description.

BRIEF DESCRIPTION OF THE DRAWINGS

The above and other aspects, features, and advantages of the present disclosure will become apparent from the detailed description of the following aspects in conjunction with the accompanying drawings, in which.

DETAILED DESCRIPTION

Figure 1:
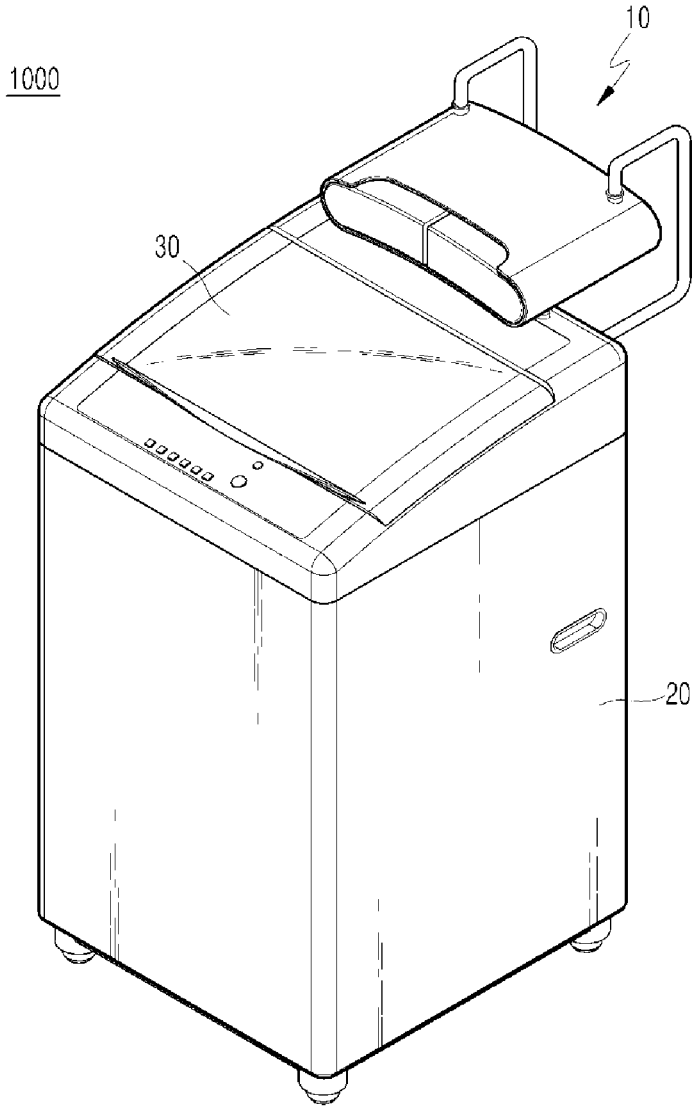
FIG. 1 is a perspective view illustrating a washing machine according to an embodiment of the present disclosure.

Advantages and features of the present disclosure and methods for achieving them will become apparent from the descriptions of aspects herein below with reference to the accompanying drawings. However, the present disclosure is not limited to the aspects disclosed herein but may be implemented in various different forms. The aspects are provided to make the description of the present disclosure thorough and to fully convey the scope of the present disclosure to those skilled in the art. It is to be noted that the scope of the present disclosure is defined only by the claims.

The shapes, sizes, ratios, angles, the number of elements given in the drawings are merely exemplary, and thus, the present disclosure is not limited to the illustrated details. Like reference numerals designate like elements throughout the specification.

In relation to describing the present disclosure, when the detailed description of the relevant known technology is determined to unnecessarily obscure the gist of the present disclosure, the detailed description may be omitted.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The term "or" is meant to be inclusive and means either, any, several, or all of the listed items.

Hereinafter, exemplary embodiments of the present disclosure will be described in detail with reference to the accompanying drawings. However, in the description of the present disclosure, a description of a function or configuration already publicly known will be omitted in order clarify the subject matter of the present disclosure.

Figure 2:
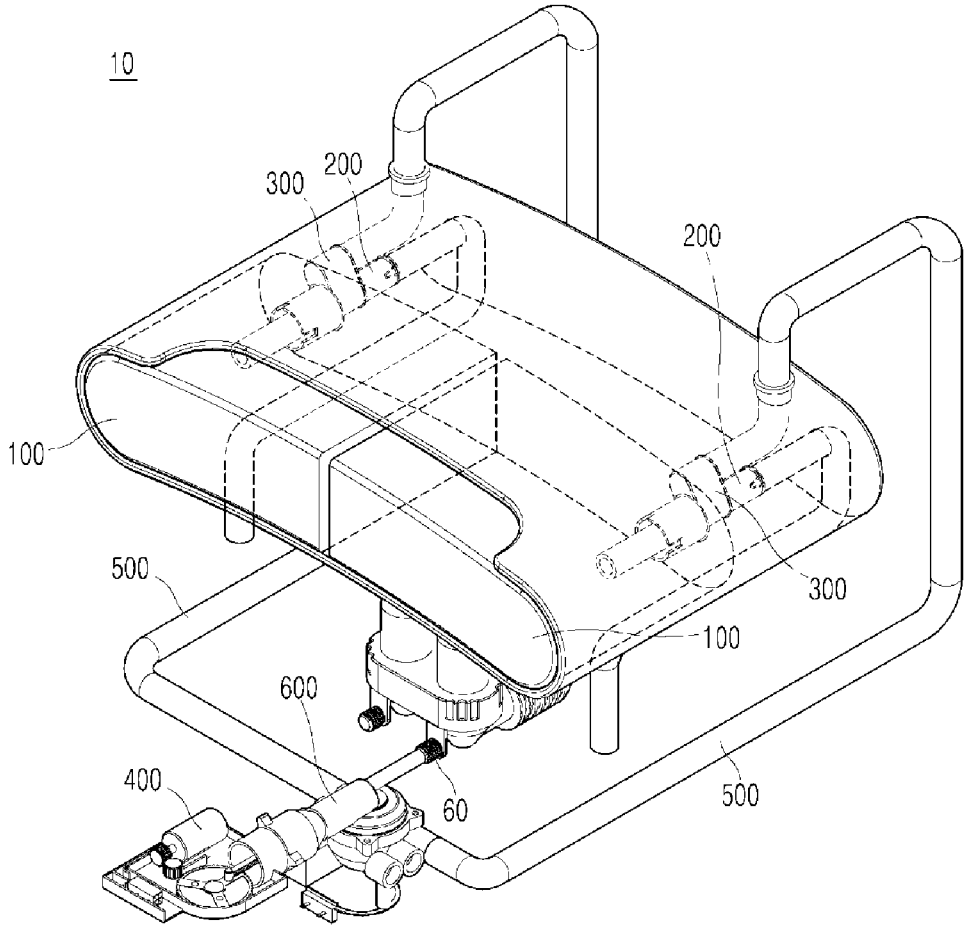
FIG. 2 is a perspective view illustrating an example of an additive supply unit of the washing machine according to the embodiment of the present disclosure.
Figure 3:
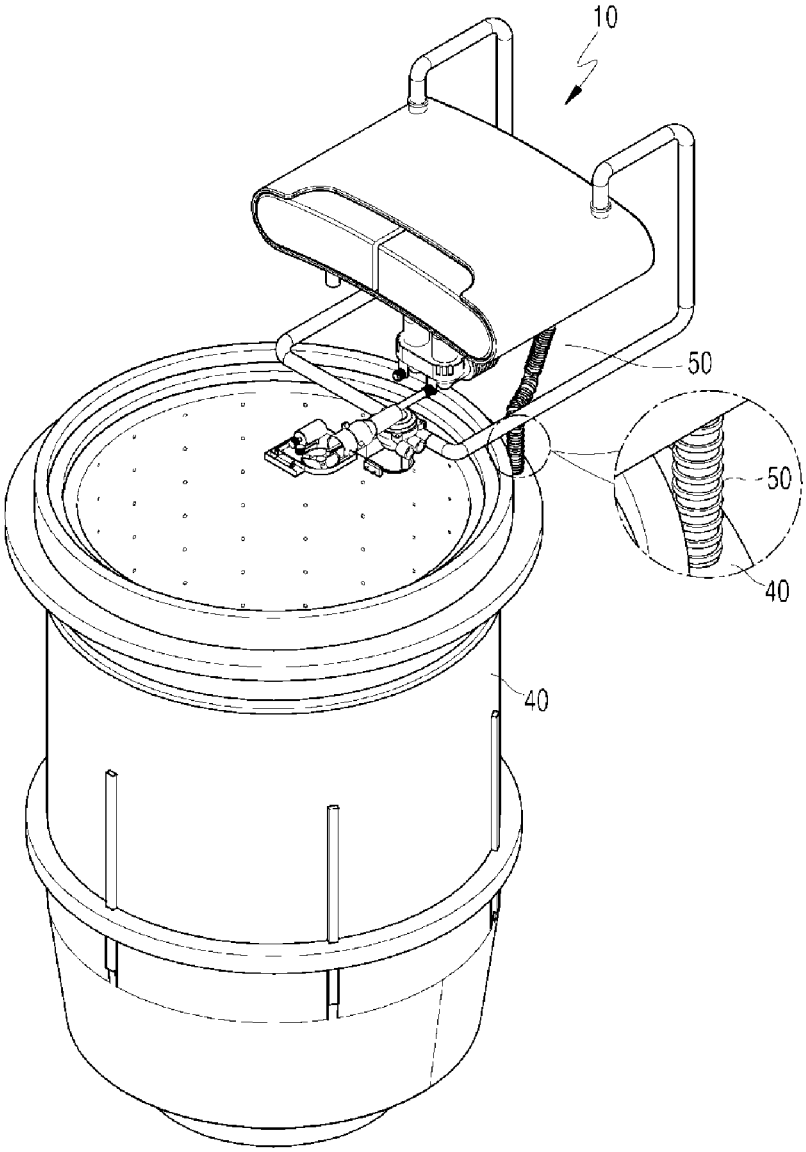
FIG. 3 is a view illustrating an example in which the additive supply unit is connected to a washing tub in the washing machine according to the embodiment of the present disclosure.

FIG. 1 is a perspective view illustrating a washing machine according to an embodiment of the present disclosure. FIG. 2 is a perspective view illustrating an example of an additive supply unit of the washing machine according to the embodiment of the present disclosure. FIG. 3 is a view illustrating an example in which the additive supply unit is connected to a washing tub in the washing machine according to the embodiment of the present disclosure.

As illustrated in FIGS. 1 to 3, a washing machine 1000 according to an embodiment of the present disclosure includes a cabinet 20, a cabinet cover 30, a washing tub 40, an additive supply unit 10, and a water supply tube 60.

The cabinet 20 defines a main external appearance of the washing machine 1000. In a state in which the washing tub 40 is installed in the cabinet 20, laundry may be inputted into the washing tub 40 through an opening formed at an upper side of the cabinet 20.

The cabinet cover 30 is coupled to the cabinet 20 and configured to open or close the opening of the cabinet 20. The cabinet cover 30 may be hingedly coupled to the upper side of the cabinet 20 so that the cabinet cover 30 may rotate about one side thereof.

Meanwhile, an input unit and/or a display unit may be installed on the cabinet cover 30. The input unit may have a plurality of operating buttons (e.g., a power button, an operation button, and the like) and function buttons (e.g., a washing course button, an option button, and the like). The display unit may display operations and states of the washing machine 1000.

The washing tub 40 is installed in the cabinet 20 and treats laundry accommodated therein. The washing tub 40 may include a stationary tub configured to accommodate supplied washing water, and a rotary tub configured to rotate clockwise or counterclockwise in the stationary tub.

Meanwhile, a pulsator may be installed on a lower surface of the rotary tub of the washing tub 40 and produce a water flow (water current). In addition, a rotary motor and a water drain unit may be installed on a lower portion of the stationary tub in the cabinet 20. The rotary motor may operate the rotary tub and the pulsator, and the water drain unit may discharge contaminated washing water, which has been used for washing, to the outside.

In addition, a water supply tube 60 may be installed at one side of the cabinet 20 and guide water, which is supplied from an external water source, into the washing machine 1000.

The additive supply unit 10 is installed to supply an additive A to the washing tub 40. The additive supply unit 10 supplies the additive A such as a detergent, a fabric softener, and a bleaching agent to the washing tub 40 so that various types of treatment are performed on the laundry.

The water supply tube 60 is coupled to the additive supply unit 10 so that the washing water is supplied to the washing tub 40 via the additive supply unit 10. The water supply tube 60 may include a water supply valve, a water supply port, and the like.

According to the configuration of the washing machine 1000 according to the present embodiment described above, when the supply of the additive A from the additive supply unit 10 to the washing tub 40 is completed, the supply path for the additive A is washed by the washing water supplied from the water supply tube 60.

Referring to FIGS. 2 and 3, a specific configuration of the additive supply unit 10 according to the present embodiment will be described.

The additive supply unit 10 of the washing machine 1000 according to the embodiment of the present disclosure includes cartridges 100, discharge tubes 200, check valve assemblies 300, a pump 400, and pressure tubes 500.

The cartridge 100 may accommodate a liquid additive A therein and discharge the additive A through a discharge port formed at one side of the cartridge 100. The cartridge 100 may accommodate the additive A therein as the user supplements various types of additives A (e.g., a general washing detergent, a wool detergent, a baby clothing detergent, an outdoor clothing detergent, a bleaching agent, a fabric softener, and the like) into the cartridge 100.

In this case, the cartridge 100 may include a cartridge body configured to define a main body and store the additive A, a first opening portion through which the additive A may be inputted into the cartridge body, a cap configured to open or close the first opening portion, a membrane configured to allow the inside of the cartridge 100 to communicate with outside air, a second opening portion in which the membrane is installed, a cartridge locker configured to fix the cartridge 100 a position at which the cartridge 100 is installed, a docking valve configured to connect the check valve assembly 300 and the cartridge 100, and a rib configured to prevent the additive A from coming into contact with the membrane.

In addition, the cartridge body has a docking valve insertion port formed in one surface thereof, and the docking valve may be inserted into the insertion port and thus installed on the cartridge body. The docking valve insertion port may be formed in a rear surface of the cartridge body. The insertion port is formed at a lower side of the rear surface, such that the additive A may flow into the check valve assembly 300 through the docking valve even in a case in which a small amount of additive A is stored in the cartridge 100. Therefore, the cartridge 100 may be inclined downward in a rearward direction.

Meanwhile, a separate electrode sensor may be installed in the cartridge 100. The electrode sensor outputs a signal when electric current flows through a medium between two electrodes, i.e., positive (+) and negative (−) electrodes spaced apart from each other. Therefore, in a case in which a sufficient amount of additive A is stored in the cartridge 100, the additive A serves as the medium, such that electric current flows. The electrode sensor may detect the flow of electric current, thereby detecting the amount of additive A in the cartridge 100.

The discharge tube 200 is connected to the cartridge 100 so as to provide a discharge path for the additive A discharged from the cartridge 100. The discharge tube 200 may guide the additive A discharged from the cartridge 100 so that the additive A flows toward the washing tub 40.

In this case, the discharge tube 200 may guide only the additive A toward the washing tub 40 or guide a mixture of the additive A and the washing water supplied from the water supply tube 60 toward the washing tub 40.

The check valve assembly 300 is interposed between the cartridge 100 and the discharge tube 200 and selectively opens or closes the discharge tube 200 and the discharge port of the cartridge 100 depending on a change in pressure. When the additive A needs to be discharged, the check valve assembly 300 selectively opens the discharge tube 200 and the discharge port of the cartridge 100 so that the additive A may flow into the discharge tube 200 from the cartridge 100.

The pump 400 generates a pressure to be provided to the check valve assembly 300. The pressure generated by the pump 400 may be transmitted to the check valve assembly 300 and applied as a discharge pressure for discharging the additive A.

The pressure tube 500 connects the check valve assembly 300 and the pump 400 so that the pressure generated by the pump 400 is transmitted to the check valve assembly 300. The pressure tube 500 may have various lengths and shapes to transmit the discharge pressure in a state in which the pump 400 and the cartridge 100 are spaced apart from each other.

According to the configuration of the additive supply unit 10 according to the present embodiment described above, the water supply tube 60 may be configured as one of the components of the additive supply unit 10. After the discharge of the additive A is completed, the water supply tube 60 may supply washing water to wash at least one of the discharge tube 200 and the check valve assembly 300.

According to the additive supply unit 10 and the washing machine 1000 including the same according to the present embodiment described above, at least one of the discharge tube 200 and the check valve assembly 300 is washed by the washing water supplied through the water supply tube 60 after the discharge of the additive A is discharged. Therefore, since the discharge path for the additive A is washed, it is possible to prevent the discharge path from being clogged and contaminated.

According to the additive supply unit 10 and the washing machine 1000 including the same according to the present embodiment, the cartridge 100 may be provided in plural, and the plurality of cartridges 100 may be separately installed and accommodate different additives A. The discharge tubes 200, the check valve assemblies 300, and the pressure tubes 500 may be installed to correspond to the respective cartridges 100.

That is, two or more cartridges 100 may be provided and connected to the discharge tubes 200, the check valve assemblies 300, and the pressure tubes 500, respectively.

Therefore, in a state in which one cartridge accommodates a detergent, another cartridge accommodates a fabric softener, and still another cartridge accommodates a bleaching agent among the plurality of cartridges 100, the discharge pressure may be provided to the respective cartridges 100 through the independent pressure tubes 500. Therefore, the respective additives A may be guided to the washing tub 40 through the independent check valve assemblies 300 and the independent discharge tubes 200.

According to the additive supply unit 10 and the washing machine 1000 including the same according to the present embodiment described above, the cartridge 100 is provided in plural, and the discharge tubes 200, the check valve assemblies 300, and the pressure tubes 500 are installed to correspond to the plurality of cartridges 100, respectively. Therefore, it is possible to supply the plurality of different additives A to the single washing tub 40.

The additive supply unit 10 and the washing machine 1000 including the same according to the present embodiment may further include a flexible tube 50 configured to be bendable and stretchable and connect the washing tub 40 and the discharge tube 200 to guide the additive A, which is discharged from the additive supply unit 10, into the washing tub 40.

That is, as illustrated in FIG. 3, the additive A discharged from the discharge tube 200 may flow into the washing tub 40 through the flexible tube 50. In this case, the flexible tube 50 may be coupled to an inlet port formed in an upper surface of the washing tub 40, thereby stably introducing the additive A into the washing tub 40.

In particular, even though the washing tub 40 is vibrated by the operation of the washing machine 1000, the flexible tube 50 may cancel out the vibration of the washing tub 40 while being bent or stretched. Therefore, there may be no problem with the function of the additive supply unit 10 even when the washing machine 1000 operates.

To this end, the flexible tube 50 may be a rubber material having both ductility and elasticity or provided in the form of a corrugated pipe.

According to the additive supply unit 10 and the washing machine 1000 including the same according to the present embodiment described above, the additive supply unit 10 and the washing tub 40 are connected to each other by means of the bendable, stretchable, and flexible tube 50. Therefore, the supply of the additive A may be smoothly performed even when the washing tub 40 operates.

According to the additive supply unit 10 and the washing machine 1000 including the same according to the present embodiment, the additive supply unit 10 may further include a flow path switching valve 600 interposed between the pump 400 and the pressure tube 500 and configured to selectively transmit the pressure generated by the pump 400 to any one of the plurality of pressure tubes 500.

That is, the single pump 400 may be connected to the flow path switching valve 600, and the flow path switching valve 600 may be connected to the respective pressure tubes 500. Therefore, the pressure generated by the pump 400 may be transmitted only to any one of the pressure tubes 500 by the flow path switching valve 600.

In this case, the flow path switching valve 600 may be controlled by a separate control unit. Information on the additive A, such as composition ratios between components constituting the additive A, may be stored in the memory. Any one of the components is accommodated in each of the cartridges 100. The control unit may control the flow path switching valve 600 on the basis of the information on the additive A stored in the memory.

On the basis of the setting inputted through the input unit by the user, the control unit may select the type of additive A from the memory and check the information on the additive A. Further, the control unit may control an operation of the flow path switching valve 600 in order to implement the additive A selected in this manner. That is, the control unit may control the operation of the flow path switching valve 600 corresponding to the cartridge 100, which accommodates the additive A, depending on the additives A used to implement the selected additive A and a composition ratio between the additives A.

According to the additive supply unit 10 and the washing machine 1000 including the same according to the present embodiment described above, the flow path switching valve 600 may be installed and selectively provide the pressure generated from the pump 400 to any one of the plurality of cartridges 100. Therefore, it is possible to simplify the structure of the additive supply unit 10 by minimizing the number of pumps 400 to be installed.

Figure 4:
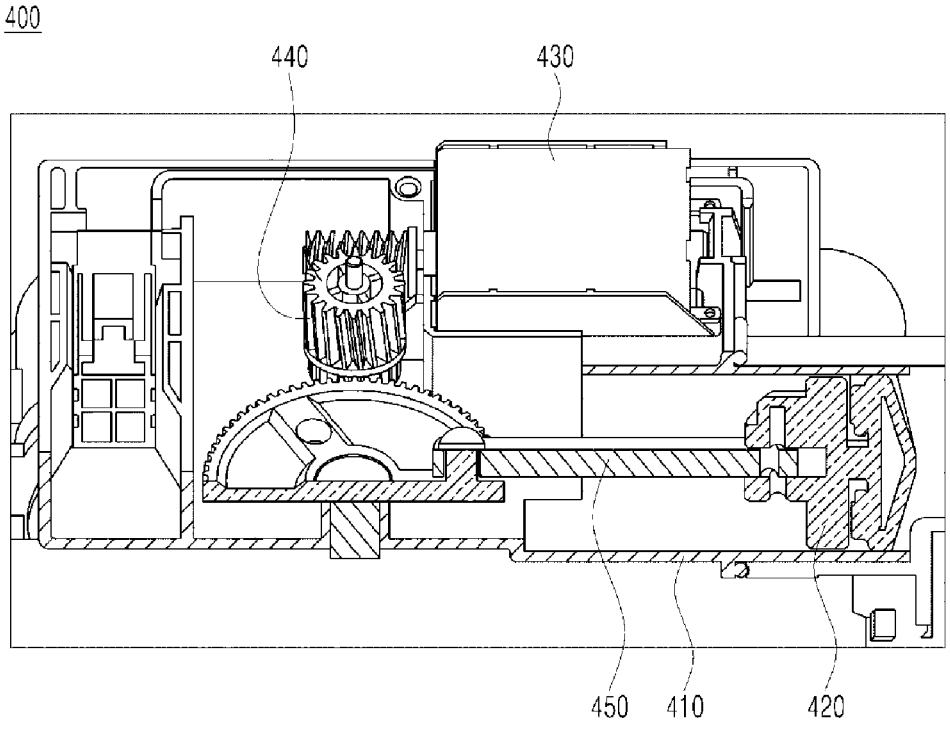
FIG. 4 is a view illustrating a more detailed configuration of a pump of the additive supply unit illustrated in FIG. 2.
Figure 5:
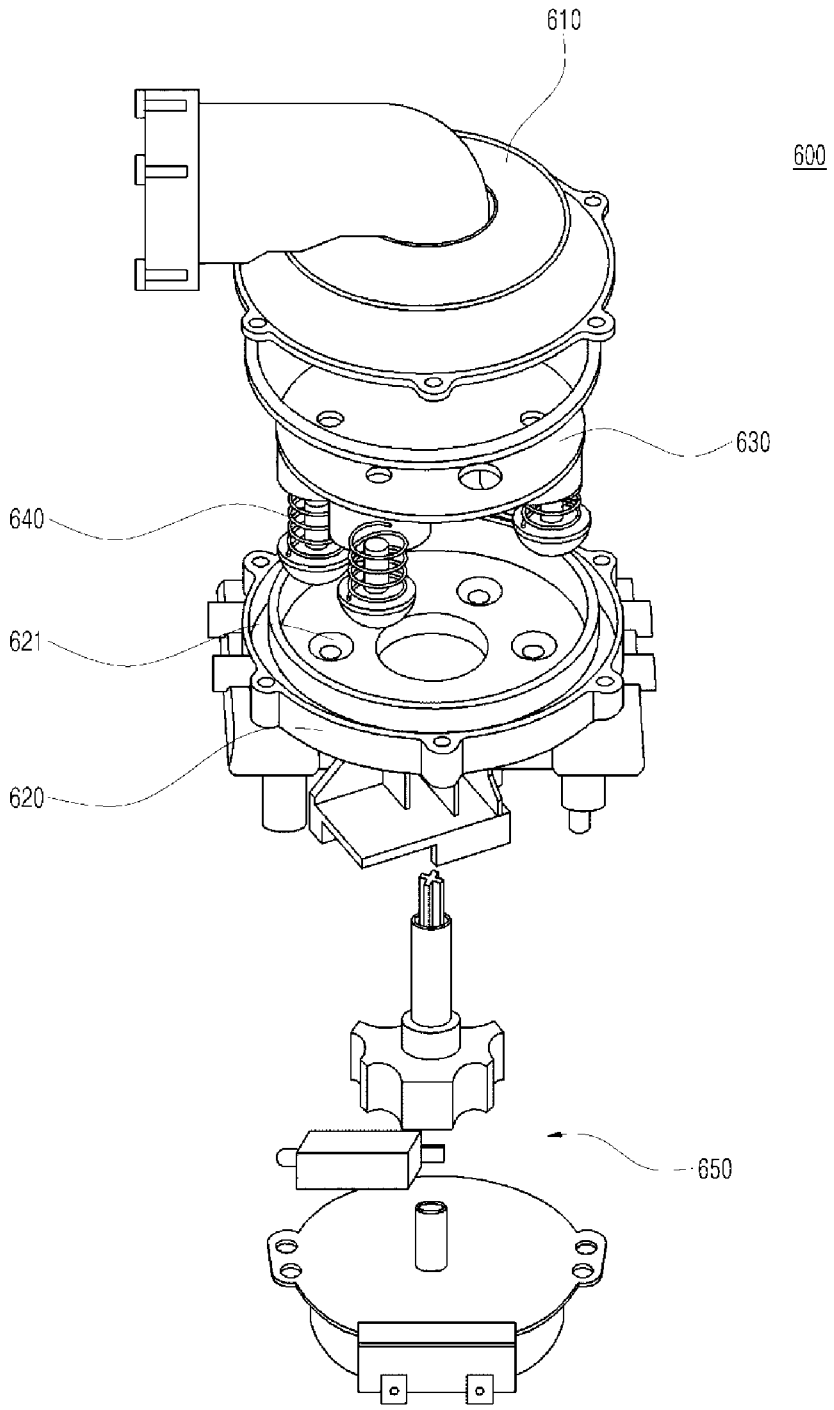
FIG. 5 is a view illustrating a more detailed configuration of a flow path switching valve of the additive supply unit illustrated in FIG. 2.
Figure 6:
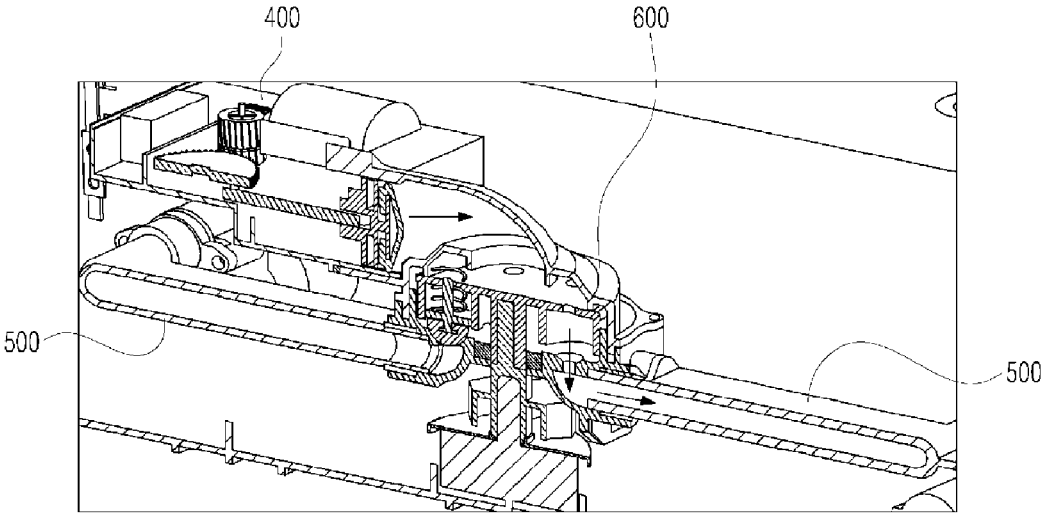
FIG. 6 is a view illustrating an example in which a pressure, which is generated by an operation of the pump of the additive supply unit illustrated in FIG. 2, is transmitted through the flow path switching valve.

FIG. 4 is a view illustrating a more detailed configuration of the pump of the additive supply unit illustrated in FIG. 2. FIG. 5 is a view illustrating a more detailed configuration of the flow path switching valve of the additive supply unit illustrated in FIG. 2. FIG. 6 is a view illustrating an example in which a pressure, which is generated by an operation of the pump of the additive supply unit illustrated in FIG. 2, is transmitted through the flow path switching valve.

According to the additive supply unit 10 and the washing machine 1000 including the same according to the present embodiment, the pump 400 may include a cylinder 410 connected to the flow path switching valve 600, and a piston 420 configured to reciprocate in the cylinder 410 and provide the pressure to the flow path switching valve 600.

Specifically, the pump 400 may include a pump housing, the piston 420 configured to change the pressure while moving forward or rearward, the cylinder 410 configured to define a space in which the piston 420 moves forward or rearward, a motor 430 configured to generate power, a gear 440 configured to be rotated by the motor 430, and a connecting rod 450 configured to connect the gear 440 and the piston 420.

In this case, the piston 420 may be inserted and installed into the cylinder 410 and reciprocate in a longitudinal direction of the cylinder 410. The rectilinear motion of the piston 420 may transmit a positive or negative pressure to the flow path switching valve 600 connected to the cylinder 410. The piston 420 transmits the positive pressure to the flow path switching valve 600 while moving in a direction toward the flow path switching valve 600, and the piston 420 transmits the negative pressure to the flow path switching valve 600 while moving a direction away from the flow path switching valve 600.

According to the additive supply unit 10 and the washing machine 1000 including the same according to the present embodiment described above, the piston 420 of the pump 400 provides the pressure for discharging the additive A while reciprocating in the cylinder 410. Therefore, it is possible to transmit the pressure to various paths by using a fluid.

According to the additive supply unit 10 and the washing machine 1000 including the same according to the present embodiment, the flow path switching valve 600 may include a first housing 610 connected to the cylinder 410, a second housing 620 having a plurality of connectors 621 configured to communicate with the respective pressure tubes 500, correspond to the respective pressure tubes 500, and be connected to the respective pressure tubes 500, the second housing 620 being coupled to the first housing 610, and a disc 630 rotatably installed between the first housing 610 and the second housing 620, and spring valves 640 installed on the disc 630 and configured to selectively open or close some of the plurality of connectors 621 depending on the rotation of the disc 630.

Specifically, the first housing 610 may define an upper external appearance of the flow path switching valve 600, and the second housing 620 may define a lower external appearance of the flow path switching valve 600.

The spring valve 640 may include a spring configured to provide an elastic force, a spring shaft configured to prevent the spring from separating, and a stopper part configured to block and close the connector 621 by being operated by the elastic force of the spring.

The disc 630 may have insertion holes in which the spring shafts are respectively inserted so that the positions of the spring valves 640 are fixed, and disc holes through which the fluid passes. The fluid introduced into the flow path switching valve 600 may pass through the disc 630 through the disc holes and partially pass through the insertion holes.

The second housing 620 has the connectors 621 respectively coupled to the plurality of pressure tubes 500 and configured to communicate with the respective pressure tubes 500. The fluid passing through the disc holes and the insertion holes of the disc 630 may be supplied to the respective pressure tubes 500 through the connectors 621.

The spring valves 640 may selectively open or close some of the plurality of connectors 621. When the disc 630 rotates and the spring valves 640 close some of the plurality of connectors 621, the remaining connectors may be opened.

Meanwhile, the flow path switching valve 600 may further include a drive unit 650 configured to control the rotation of the disc 630. The drive unit 650 may include a flow path switching motor, a shaft, a microswitch, a plane cam, and the like.

In this case, the spring valves 640 installed on the disc 630 may rotate in conjunction with the rotation of the disc 630. When the connector 621 of the second housing 620 is positioned at a rotation position of the spring valve 640, the stopper part may block the corresponding connector 621 while being operated by the elastic force of the spring.

To connect the pump 400 to the check valve assembly 300 connected to the cartridge 100 that stores the additive A to be supplied, the control unit may control a rotation angle of the disc 630 so that the spring valve 640 is not positioned on the connector 621 connected to the corresponding check valve assembly 300.

When the spring valve 640 is not positioned on the connector 621, the connector 621 may communicate with the pump 400, the positive or negative pressure generated by the pump 400 may be sequentially transmitted to the pressure tube 500 and the check valve assembly 300 through the connector 621, thereby discharging the additive A from the cartridge 100.

Meanwhile, the drive unit 650 of the flow path switching valve 600 may include the microswitch and the plane cam to accurately control the rotation angle of the disc 630. The plane cam may be integrated with the shaft or coupled to the shaft and rotate integrally with the shaft and the disc 630.

The microswitch may have an actuator, and electric circuit may be changed by a motion of the actuator. The cam rotates (or reciprocates) and has a special contour (or, groove), and the plane cam is a kind of cam having a contour including a plane curve.

The plane cam has a plurality of protruding portions having different shapes and spacing distances and thus has a special contour. When the plane cam rotates, the protruding portion pushes the actuator of the microswitch and allows electric current to flow.

On the basis of the pattern in which the electric current flows, the control unit may determine the rotation position of the disc 630 and perform control. The plane cam and the shaft may be coupled to the driving shaft of the flow path switching motor and rotated, and the microswitch may be disposed so that the actuator is in contact with the plane cam.

According to the additive supply unit 10 and the washing machine 1000 including the same according to the present embodiment described above, when the disc 630 rotatably installed in the housing of the flow path switching valve 600 rotates, the spring valves 640 selectively open or close some of the plurality of connectors 621, thereby selectively providing the pressure. Therefore, it is possible to selectively transmit the pressure to a larger number of paths by means of the single flow path switching valve 600.

Figure 7:
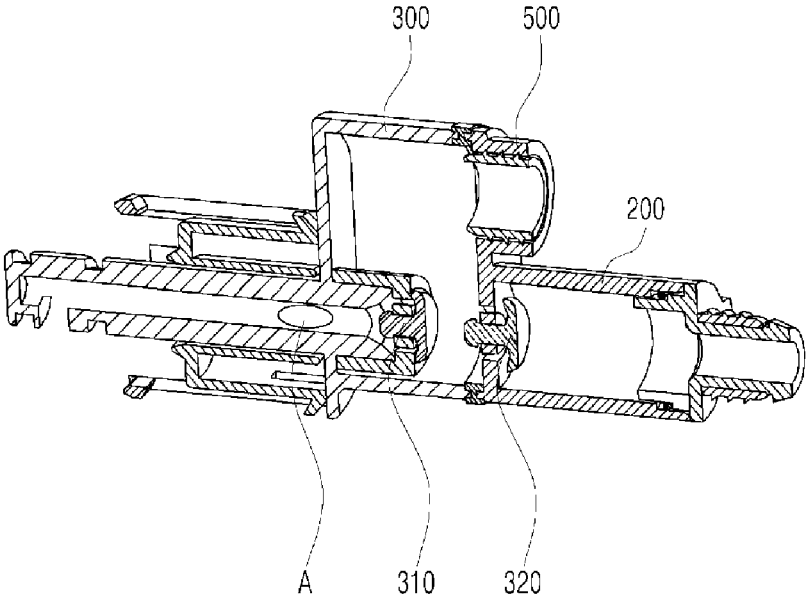
FIGS. 7 to 9 are views illustrating an example in which an additive is discharged through a check valve assembly of the additive supply unit illustrated in FIG. 2.
Figure 8:
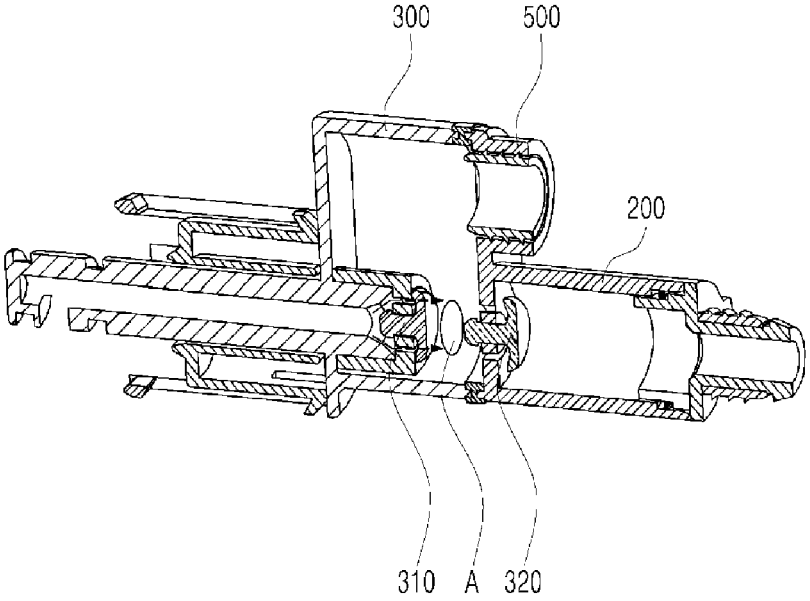
Figure 9:
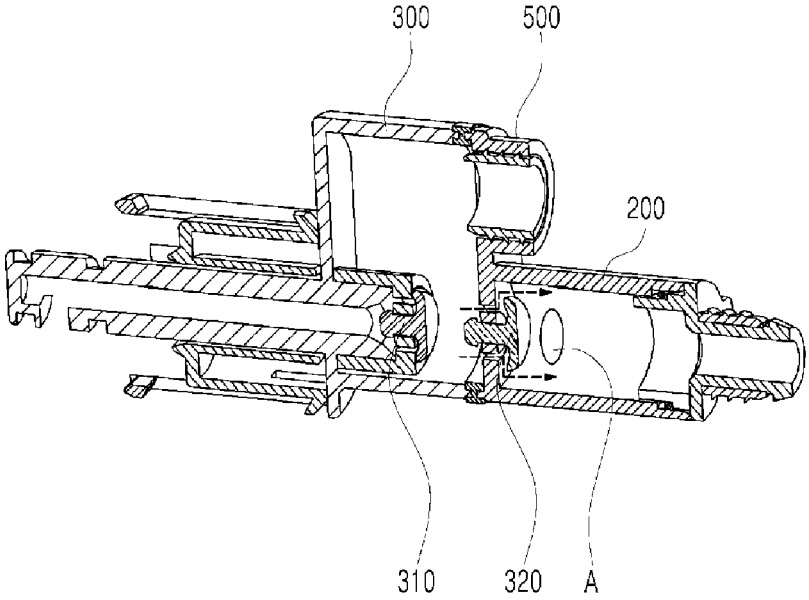

FIGS. 7 to 9 are views illustrating an example in which an additive is discharged through the check valve assembly of the additive supply unit illustrated in FIG. 2.

According to the additive supply unit 10 and the washing machine 1000 including the same according to the present embodiment, the check valve assembly 300 may include: a first check valve 310 installed at a portion coupled to the discharge port of the cartridge 100, the first check valve 310 being configured to be opened in a direction in which the additive A is discharged when the internal pressure decreases; and a second check valve 320 installed at a portion coupled to the discharge tube 200, the second check valve 320 being configured to be opened in a direction in which the additive A is discharged when the internal pressure increases.

Specifically, a space may be formed in the check valve assembly 300 and temporarily accommodate the additive A discharged from the cartridge 100. One side of the space may communicate with the discharge port of the cartridge 100, and the other side of the space may communicate with the discharge tube 200. The first check valve 310 may be disposed at one side of the space, and the second check valve 320 may be disposed at the other side of the space.

First, as illustrated in FIG. 7, the additive A may be kept accommodated in the cartridge 100 before the pump 400 operates in a state the cartridge 100 is coupled to the check valve assembly 300.

Next, as illustrated in FIG. 8, when the piston 420 moves rearward, a pressure in the internal space of the check valve assembly 300 may decrease. When the pressure in the internal space of the check valve assembly 300 decreases and the first check valve 310 is opened as described above, the additive A is introduced into the internal space of the check valve assembly 300, the second check valve 320 is closed, and the additive A is temporarily stored in the internal space of the check valve assembly 300.

Next, as illustrated in FIG. 9, when the piston 420 moves forward, the pressure in the internal space of the check valve assembly 300 may increase. When the pressure in the internal space of the check valve assembly 300 increases as described above, the first check valve 310 is closed, and the second check valve 320 is opened. Therefore, the additive A temporarily stored in the internal space of the check valve assembly 300 is discharged to the discharge tube 200.

In this case, the first and second check valves 310 and 320 may each have a circular hemispheric shape and be made of a rubber material having elasticity. The first and second check valves 310 and 320 may each have one end provided in the form of a protrusion portion, and the other end provided in the form of a hemispheric portion, such that a flat surface of the hemispheric portion may be seated in one direction in the discharge path for the additive A.

According to the additive supply unit 10 and the washing machine 1000 including the same according to the present embodiment described above, the check valve assembly 300 includes the first and second check valves 310 and 320 configured to be opened or closed in opposite directions depending on change in pressure in the check valve assembly 300. Therefore, it is possible to effectively prevent a reverse flow during a process in which the additive A is discharged.

Meanwhile, the additive supply unit 10 and the washing machine 1000 including the same according to the present embodiment may use air as a fluid for operating the first and second check valves 310 and 320.

The cylinder 410 and the pressure tube 500 may be filled with air, and the reciprocating motion of the piston 420 may allow the air to flow between the spaces formed in the cylinder 410, the pressure tube 500, and the check valve assembly 300. Therefore, the pressure, which varies, may be transmitted to the space in the check valve assembly 300.

According to the additive supply unit 10 and the washing machine 1000 including the same according to the present embodiment, the cartridge 100 and the check valve assembly 300 may be installed on the cabinet cover 30, and the pump 400 and the flow path switching valve 600 may be installed in the cabinet 20.

That is, as illustrated in FIG. 1, the cartridge 100 and the check valve assembly 300 may be installed to be exposed to the outside of the washing machine 1000, and the pump 400 and the flow path switching valve 600 may be installed in the cabinet 20 of the washing machine 1000. In this case, the pressure tube 500 and the discharge tube 200 may be partially exposed to the outside of the washing machine 1000, and the remaining portion of the pressure tube 500 and the remaining portion of the discharge tube 200 may be installed in the cabinet 20 of the washing machine 1000.

In the case of the general washing machine 1000, a predetermined dummy space may be present in the cabinet 20. Further, a vacant space in which no special member is installed may be present in consideration of interference and the like between the respective members.

Therefore, the pump 400 and the flow path switching valve 600 may be disposed by using the dummy space. The cartridge 100, which has a relatively large scale and needs to be configured such that the user may easily approach the cartridge 100, may be disposed outside the washing machine 1000.

In this case, since the check valve assembly 300 may be coupled adjacent to the cartridge 100, the check valve assembly 300 may also be disposed outside the washing machine 1000.

According to the additive supply unit 10 and the washing machine 1000 including the same according to the present embodiment described above, a part of the additive supply unit 10 is installed on the cabinet cover 30, and the remaining portion of the additive supply unit 10 is installed in the cabinet 20. Therefore, it is possible to further simplify the overall external appearance of the washing machine 1000 by minimizing the portions exposed to the outside of the washing machine 1000.

In this case, the cartridge 100 and the check valve assembly 300 may be detachably installed on the cabinet cover 30. That is, the cartridge 100 and the check valve assembly 300, which are installed to be exposed to the outside of the washing machine 1000 as described above, may be separated from the washing machine 1000.

The additive supply unit 10 serves to improve the convenience of using the washing machine 1000. There may be users who are not familiar with the automatic supply of the additive A or does not prefer the automatic supply of the additive A. Therefore, when the necessity of the additive supply unit 10 is low, as described above, the components exposed to the outside of the washing machine 1000 may be separated from the washing machine 1000.

In addition, to use more various additives A, different types of additive supply units 10 may be installed on the washing machine 1000. Therefore, the existing cartridge 100 and the existing check valve assembly 300 may be separated, and then a new cartridge 100 and a new check valve assembly 300 may be coupled to the washing machine 1000 and used.

In addition, even in the case of the existing washing machine that has no additive supply unit 10 but has the pump 400 and the flow path switching valve 600 embedded in the washing machine previously, the remaining components may be coupled to the pump 400 and the flow path switching valve 600 later to use the additive supply unit 10.

According to the additive supply unit 10 and the washing machine 1000 including the same according to the present embodiment described above, the cartridge 100 and the check valve assembly 300 may be separately installed on the cabinet cover 30. The cartridge 100 and the check valve assembly 300 may be coupled to the pump 400 and the flow path switching valve 600 installed in the cabinet 20, and then used, as necessary. Therefore, it is possible to further optimize the structure of the washing machine 1000 so that at least a part of the additive supply unit 10 may be separated and replaced.

Figure 10:
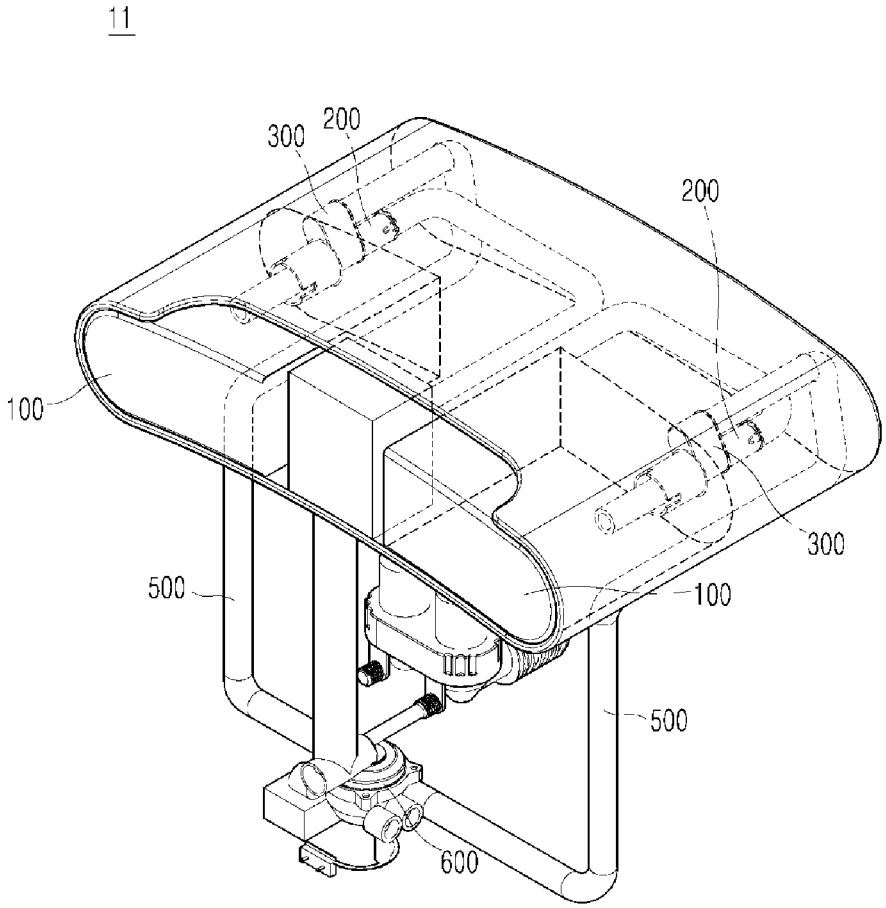
FIG. 10 is a perspective view illustrating a modified example of the additive supply unit of the washing machine according to the embodiment of the present disclosure.

FIG. 10 is a perspective view illustrating a modified example of the additive supply unit of the washing machine according to the embodiment of the present disclosure.

As illustrated in FIG. 10, an additive supply unit 11 of the washing machine 1000 according to the embodiment of the present disclosure, which has partially modified components, may use hydraulic pressure of the washing water supplied through the water supply tube 60, as the discharge pressure for the additive A, in a state in which no separate power source is installed.

That is, the pressure tube 500 of the additive supply unit 11 may connect the check valve assembly 300 and the water supply tube 60 to transmit the hydraulic pressure of the washing water supplied from the water supply tube 60 into the check valve assembly 300.

Of course, in this case, the pressure tubes 500 may be coupled to the flow path switching valve 600, and the flow path switching valve 600 may be coupled to the water supply tube 60, such that the hydraulic pressure may be selectively supplied to the respective pressure tubes 500.

Specifically, water may be used as the fluid for operating the first and second check valves 310 and 320. In this case, the water supply tube 60 may be coupled to the cylinder 410 into which the piston 420 is inserted and coupled.

The cylinder 410 and the pressure tube 500 may be filled with water, and the reciprocating motion of the piston 420 may allow the water to flow between the spaces formed in the cylinder 410, the pressure tube 500, and the check valve assembly 300. Therefore, the pressure, which varies, may be transmitted to the space in the check valve assembly 300.

Meanwhile, in the case in which the additive supply unit 11 is provided as described above, the additive A discharged through the discharge tube 200 is not inputted directly into the washing tub 40 but may be inputted into the washing tub 40 through the flow path switching valve 600.

According to the additive supply unit 11 and the washing machine 1000 including the same according to the present embodiment described above, the hydraulic pressure of the washing water supplied from the water supply tube 60 may be transmitted into the check valve assembly 300 and used as the pressure for discharging the additive A. Therefore, it is possible to discharge the additive A without a separate power source.

According to at least one of the embodiments of the present disclosure, at least one of the discharge tube and the check valve assembly is washed by the washing water supplied through the water supply tube after the discharge of the additive is discharged. Therefore, since the discharge path for the additive is washed, it is possible to prevent the discharge path from being clogged and contaminated.

In addition, according to at least one of the embodiments of the present disclosure, the cartridge is provided in plural, and the discharge tubes, the check valve assemblies, and the pressure tubes are installed to correspond to the plurality of cartridges, respectively. Therefore, it is possible to supply the plurality of different additives to the single washing tub.

In addition, according to at least one of the embodiments of the present disclosure, the flow path switching valve may be installed and selectively provide the pressure generated from the pump to any one of the plurality of cartridges. Therefore, it is possible to simplify the structure of the additive supply unit by minimizing the number of pumps to be installed.

In addition, according to at least one of the embodiments of the present disclosure, the additive supply unit and the washing tub are connected to each other by means of the bendable, stretchable, and flexible tube. Therefore, the supply of the additive may be smoothly performed even when the washing tub operates.

In addition, according to at least one of the embodiments of the present disclosure, the piston of the pump provides the pressure for discharging the additive while reciprocating in the cylinder. Therefore, it is possible to transmit the pressure to various paths by using a fluid.

In addition, according to at least one of the embodiments of the present disclosure, when the disc rotatably installed in the housing of the flow path switching valve rotates, the spring valves selectively open or close some of the plurality of connectors, thereby selectively providing the pressure. Therefore, it is possible to selectively transmit the pressure to a larger number of paths by means of the single flow path switching valve.

In addition, according to at least one of the embodiments of the present disclosure, the check valve assembly includes the first and second check valves configured to be opened or closed in opposite directions depending on change in pressure in the check valve assembly. Therefore, it is possible to effectively prevent a reverse flow during a process in which the additive is discharged.

In addition, according to at least one of the embodiments of the present disclosure, a part of the additive supply unit is installed on the cabinet cover, and the remaining portion of the additive supply unit is installed in the cabinet.

Therefore, it is possible to further simplify the overall external appearance of the washing machine by minimizing the portions exposed to the outside of the washing machine.

In addition, according to at least one of the embodiments of the present disclosure, the cartridge and the check valve assembly may be separately installed on the cabinet cover. The cartridge and the check valve assembly may be coupled to the pump and the flow path switching valve installed in the cabinet, and then used, as necessary. Therefore, it is possible to further optimize the structure of the washing machine so that at least a part of the additive supply unit may be separated and replaced.

In addition, according to at least one of the embodiments of the present disclosure, the hydraulic pressure of the washing water supplied from the water supply tube may be transmitted into the check valve assembly and used as the pressure for discharging the additive. Therefore, it is possible to discharge the additive without a separate power source.

It will of course be realized that while the foregoing has been given by way of illustrative example of this disclosure, all such and other modifications and variations thereto as would be apparent to those skilled in the art are deemed to fall within the broad scope and ambit of this disclosure as is herein set forth.

While the invention has been explained in relation to its embodiments, it is to be understood that various modifications thereof will become apparent to those skilled in the art upon reading the specification. Therefore, it is to be understood that the invention disclosed herein is intended to cover such modifications as fall within the scope of the appended claims.

The present disclosure described as above is not limited by the aspects described herein and accompanying drawings. It should be apparent to those skilled in the art that various substitutions, changes and modifications which are not exemplified herein but are still within the spirit and scope of the present disclosure may be made. Therefore, the scope of the present disclosure is defined not by the detailed description, but by the claims and their equivalents, and all variations within the scope of the claims and their equivalents are to be construed as being included in the present disclosure.

What is claimed is:

1. An additive supply apparatus for a washing machine, the additive supply apparatus comprising:

a cartridge configured to accommodate an additive therein, the cartridge having a discharge port defined at one side of the cartridge and configured to discharge the additive from the cartridge;

a discharge tube that is connected to the cartridge and defines a discharge path configured to guide the additive discharged from the cartridge;

a check valve assembly disposed between the cartridge and the discharge tube and configured to selectively open and close each of the discharge tube and the discharge port of the cartridge based on a change of a fluid pressure provided to the check valve assembly;

a pump configured to generate the fluid pressure to be provided to the check valve assembly;

a pressure tube that connects the pump to the check valve assembly and configured to transmit the fluid pressure generated from the pump to the check valve assembly; and a water supply tube connected to at least one of the discharge tube or the check valve assembly and configured to supply washing water to the at least one of the discharge tube or the check valve assembly.

2. The additive supply apparatus of claim 1, further comprising:

a plurality of cartridges including the cartridge;

a plurality of discharge tubes including the discharge tube, each of the plurality of discharge tubes being connected to one of the plurality of cartridges;

a plurality of check valve assemblies including the check valve assembly, each of the plurality of check valve assemblies being disposed between one of the plurality of cartridges and one of the plurality of discharge tubes; and a plurality of pressure tubes including the pressure tube, each of the plurality of pressure tubes connecting the pump to one of the plurality of check valve assemblies.

3. The additive supply apparatus of claim 2, further comprising:

a flow path switching valve connected to the pump and disposed between the plurality of pressure tubes, the flow path switching valve being configured to selectively transmit the fluid pressure generated from the pump to any one of the plurality of pressure tubes.

4. The additive supply apparatus of claim 3, wherein the water supply tube is connected to the flow path switching valve.

5. A washing machine comprising:

a cabinet that defines an opening at an upper side thereof;

a cabinet cover coupled to the cabinet and configured to open and close the opening of the cabinet;

a washing tub disposed in the cabinet and configured to accommodate washing water; and an additive supply apparatus connected to the washing tub and configured to supply an additive to the washing tub, wherein the additive supply apparatus comprises:

a cartridge configured to accommodate the additive therein, the cartridge having a discharge port defined at one side of the cartridge and configured to discharge the additive from the cartridge, a discharge tube that is connected to the cartridge and defines a discharge path configured to guide the additive discharged from the cartridge, a check valve assembly disposed between the cartridge and the discharge tube and configured to selectively open and close each of the discharge tube and the discharge port of the cartridge based on a change of a fluid pressure provided to the check valve assembly, a pump configured to generate the fluid pressure to be provided to the check valve assembly, a pressure tube that connects the pump to the check valve assembly and configured to transmit the fluid pressure generated from the pump to the check valve assembly, and a water supply tube coupled to at least one of the discharge tube or the check valve assembly and configured to supply washing water to the at least one of the discharge tube or the check valve assembly.

6. The washing machine of claim 5, further comprising:

a flexible tube that is bendable and stretchable and connects the discharge tube to the washing tub, the flexible tube being configured to guide the additive discharged from the additive supply apparatus into the washing tub.

7. The washing machine of claim 6, wherein the additive supply apparatus further comprises:

a plurality of cartridges including the cartridge;

a plurality of discharge tubes including the discharge tube, each of the plurality of discharge tubes being connected to one of the plurality of cartridges;

a plurality of check valve assemblies including the check valve assembly, each of the plurality of check valve assemblies being disposed between one of the plurality of cartridges and one of the plurality of discharge tubes; and a plurality of pressure tubes including the pressure tube, each of the plurality of pressure tubes connecting the pump to one of the plurality of check valve assemblies.

8. The washing machine of claim 7, wherein the additive supply apparatus further comprises a flow path switching valve connected to the pump and disposed between the plurality of pressure tubes, the flow path switching valve being configured to selectively transmit the fluid pressure generated from the pump to any one of the plurality of pressure tubes.

9. The washing machine of claim 8, wherein the pump comprises:

a cylinder connected to the flow path switching valve; and a piston disposed in the cylinder and configured to reciprocate in the cylinder to thereby generate the fluid pressure and provide the fluid pressure to the flow path switching valve.

10. The washing machine of claim 9, wherein the flow path switching valve comprises:

a first housing connected to the cylinder;

a second housing coupled to the first housing, the second housing comprising a plurality of connectors configured to communicate with the plurality of pressure tubes, respectively;

a disc rotatably disposed between the first housing and the second housing; and a plurality of spring valves disposed at the disc and configured to selectively open and close one or more of the plurality of connectors based on rotation of the disc.

11. The washing machine of claim 6, wherein the check valve assembly comprises:

a first check valve disposed at a first portion coupled to the discharge port of the cartridge, the first check valve being configured to, based on a decrease of the fluid pressure provided to the check valve assembly, move in a discharge direction of the additive to thereby open the first portion; and a second check valve disposed at a second portion coupled to the discharge tube, the second check valve being configured to, based on an increase of the fluid pressure provided to the check valve assembly, move in the discharge direction of the additive to thereby open the second portion.

12. The washing machine of claim 11, wherein the first check valve is configured to, based on the increase of the fluid pressure provided to the check valve assembly, move opposite to the discharge direction of the additive to thereby close the first portion, and wherein the second check valve is configured to, based on the decrease of the fluid pressure provided to the check valve assembly, move opposite to the discharge direction of the additive to thereby close the second portion.

13. The washing machine of claim 8, wherein the plurality of cartridges and the plurality of check valve assemblies are disposed at the cabinet cover, and wherein the pump and the flow path switching valve are disposed in the cabinet.

14. The washing machine of claim 13, wherein the plurality of cartridges and the plurality of check valve assemblies are detachably disposed at the cabinet cover.

15. The washing machine of claim 5, wherein the additive supply apparatus is disposed above the cabinet cover.

16. The washing machine of claim 5, wherein the cartridge is coupled to a first side of the check valve assembly, and wherein the pressure tube and the discharge tube are coupled to a second side of the check valve assembly opposite to the first side.

17. A washing machine comprising:

a cabinet that defines an opening at an upper side thereof;

a cabinet cover coupled to the cabinet and configured to open and close the opening of the cabinet;

a washing tub disposed in the cabinet and configured to accommodate washing water;

an additive supply apparatus coupled to the washing tub and configured to supply an additive to the washing tub; and a water supply tube connected to the additive supply apparatus and configured to supply washing water to the additive supply apparatus, wherein the additive supply apparatus comprises:

a cartridge configured to accommodate the additive therein, the cartridge having a discharge port defined at one side of the cartridge and configured to discharge the additive from the cartridge, a discharge tube that is connected to the cartridge and defines a discharge path configured to guide the additive discharged from the cartridge, a check valve assembly disposed between the cartridge and the discharge tube and configured to selectively open and close each of the discharge tube and the discharge port of the cartridge based on a change of a hydraulic pressure of washing water supplied from the water supply tube to the check valve assembly, and a pressure tube that connects the water supply tube to the check valve assembly and configured to guide the washing water from the water supply tube to the check valve assembly to thereby transmit the hydraulic pressure to the check valve assembly.

18. The washing machine of claim 17, wherein the additive supply apparatus further comprises:

a plurality of cartridges including the cartridge;

a plurality of discharge tubes including the discharge tube, each of the plurality of discharge tubes being connected to one of the plurality of cartridges;

a plurality of check valve assemblies including the check valve assembly, each of the plurality of check valve assemblies being disposed between one of the plurality of cartridges and one of the plurality of discharge tubes; and a plurality of pressure tubes including the pressure tube, each of the plurality of pressure tubes connecting the water supply tube to one of the plurality of check valve assemblies.

19. The washing machine of claim 18, wherein the additive supply apparatus further comprises a flow path switching valve connected to the water supply tube and disposed between the plurality of pressure tubes, the flow path switching valve being configured to selectively transmit the hydraulic pressure to any one of the plurality of pressure tubes.

20. The washing machine of claim 17, wherein the check valve assembly comprises:

a first check valve disposed at a first portion coupled to the discharge port of the cartridge, the first check valve being configured to, based on a decrease of the hydraulic pressure, move in a discharge direction of the additive to thereby open the first portion; and a second check valve disposed at a second portion coupled to the discharge tube, the second check valve being configured to, based on an increase of the hydraulic pressure, move in the discharge direction of the additive to thereby open the second portion.

* * * * *